US006142236A

United States Patent [19]

Brammer et al.

[11] Patent Number: 6,142,236

[45] Date of Patent: Nov. 7, 2000

[54] METHOD FOR DRILLING AND COMPLETING A SUBSEA WELL USING SMALL DIAMETER RISER

[76] Inventors: Norman Brammer, Belvedere Hause, Fyvie Turiff AB58QB, Aberdeen, United Kingdom; Philippe Nobileau, 4-40 Ch Du Vinaigrier, Villefranche-Corne d'Or, 06300 Nice, France

[21] Appl. No.: 09/259,892

[22] Filed: Feb. 18, 1999

Related U.S. Application Data

[60] Provisional application No. 60/075,048, Feb. 18, 1998.

[51] Int. Cl.[7] ..... E21B 7/12; E21B 7/128

[52] U.S. Cl. ..... 166/358; 166/351; 166/359; 166/367; 175/7; 405/195.1

[58] Field of Search ..... 166/358, 350, 166/357, 367; 405/195.1; 175/5, 7

[56] References Cited

U.S. PATENT DOCUMENTS

| | | | |
|---|---|---|---|
| 3,603,409 | 9/1971 | Watkins | 166/358 X |
| 4,063,602 | 12/1977 | Howell et al. | 175/7 |
| 4,091,881 | 5/1978 | Maus | 175/7 |
| 4,149,603 | 4/1979 | Arnold | 175/7 |
| 4,466,487 | 8/1984 | Taylor | 175/7 X |
| 4,813,495 | 3/1989 | Leach | 166/358 X |

OTHER PUBLICATIONS

Dec. 1997, "Riserless Drilling"Publication by Allen D. Gault.

*Primary Examiner*—Dennis L. Taylor
*Attorney, Agent, or Firm*—Felsman, Bradley, Vaden, Gunter, & Dillon, LLP; James Bradley

[57] ABSTRACT

A subsea wellhead assembly located at the sea floor that includes a subsea wellhead and a stationary blowout preventer mounted to the subsea wellhead for controlling a well during drilling. A drill pipe defines an annulus within the stationary blowout preventer. The drill pipe extends to a rotational drive mechanism on a drilling rig at the surface. A drilling head forms a seal against a drill pipe with a rotatable inner portion. The rotatable inner portion rotates with the drill pipe and prevents drilling fluid returns from flowing up the annulus around the drill pipe and prevents drilling fluid returns from discharging onto the seabed. The drilling head is mounted on top of the stationary blowout preventer. A riser extends upward from the drilling head and extends to a floating drilling rig. The riser has a lower end that connects into the drilling head below the drill pipe seal for receiving mud-returns flowing up around the annulus of the drill pipe. The riser is offset from and parallel to the drill pipe. After drilling, the riser is used to complete the well.

18 Claims, 3 Drawing Sheets

METHOD FOR DRILLING AND COMPLETING A SUBSEA WELL USING SMALL DIAMETER RISER

CROSS-REFERENCE TO RELATED APPLICATIONS

This application claims the benefit of provisional application serial No. 60/075,048, filed Feb. 18, 1998 in the U.S. Patent and Trademark Office.

TECHNICAL FIELD

This invention relates in general to subsea well drilling, and particularly to a riser used during drilling which is offset from the drill pipe for mud return and which is used subsequently to run tubing and a Christmas tree.

BACKGROUND OF THE INVENTION

When drilling offshore for oil production in extremely deep water and in areas where extremely high currents are encountered, the oil industry faces significant challenges in using conventional riser/mud systems. Some of the conditions that lead to difficulties are very high hydrostatic pressure. For example, in a deep formation when a bit penetrates below the mudline, the drill formation is exposed to a full mud column pressure, whereas the pore pressure is only equal to a column of sea water. An additional difficulty is the expense and size of the rig and equipment required for use to drill wells in extremely deep water. The necessity of additional and larger diameter casing strings requires a larger riser. The result of the increased riser is more wasted mud volume and greater tension and loading on the equipment. The greater tension and loading results in a requirement for larger drilling rigs.

Proposals have been made to drill without a riser. A subsea drilling head rotates with the drill pipe and seals the annulus. Drilling mud returns through a conduit to the surface. These proposals have not yet been put into practice.

DISCLOSURE OF THE INVENTION

Therefore, a riserless drilling method is desired to reduce the difficulties of excessive hydrostatic presure and increased equipment size and expense. A subsea wellhead assembly is provided at the sea floor that includes a subsea wellhead and a stationary blowout preventer mounted to the subsea wellhead for controlling a well during drilling. A drill pipe defines an annulus within the stationary blowout preventer. The drill pipe extends to a rotational drive mechanism on a drilling rig at the surface. A drilling head or drilling head is mounted to the stationary blowout preventer and forms a seal against the drill pipe with a rotatable inner portion. The rotatable inner portion rotates with the drill pipe and prevents drilling fluid returns from flowing up the annulus around the drill pipe and prevents drilling fluid returns from discharging onto the seabed. A riser extends upward from the drilling head and extends to a floating drilling rig. The riser has a lower end that connects into the drilling head below the drill pipe seal for receiving mud-returns flowing up around the annulus of the drill pipe. The riser is offset from and parallel to the drill pipe. The riser may be 7" casing. The 7" casing may be re-used as well casing on another well. Hydraulic fluid controls operatively connected to the stationary blowout preventer supply hydraulic power to actuate the stationary blowout preventer and to control the drilling head and/or valve manifold.

After drilling, the drilling head is removed, and the riser is used for completion operations. The riser runs a tubing hanger and string of tubing. Annulus access is provided by the auxiliary line.

BEST MODE FOR CARRYING OUT THE INVENTION

Figure 1:
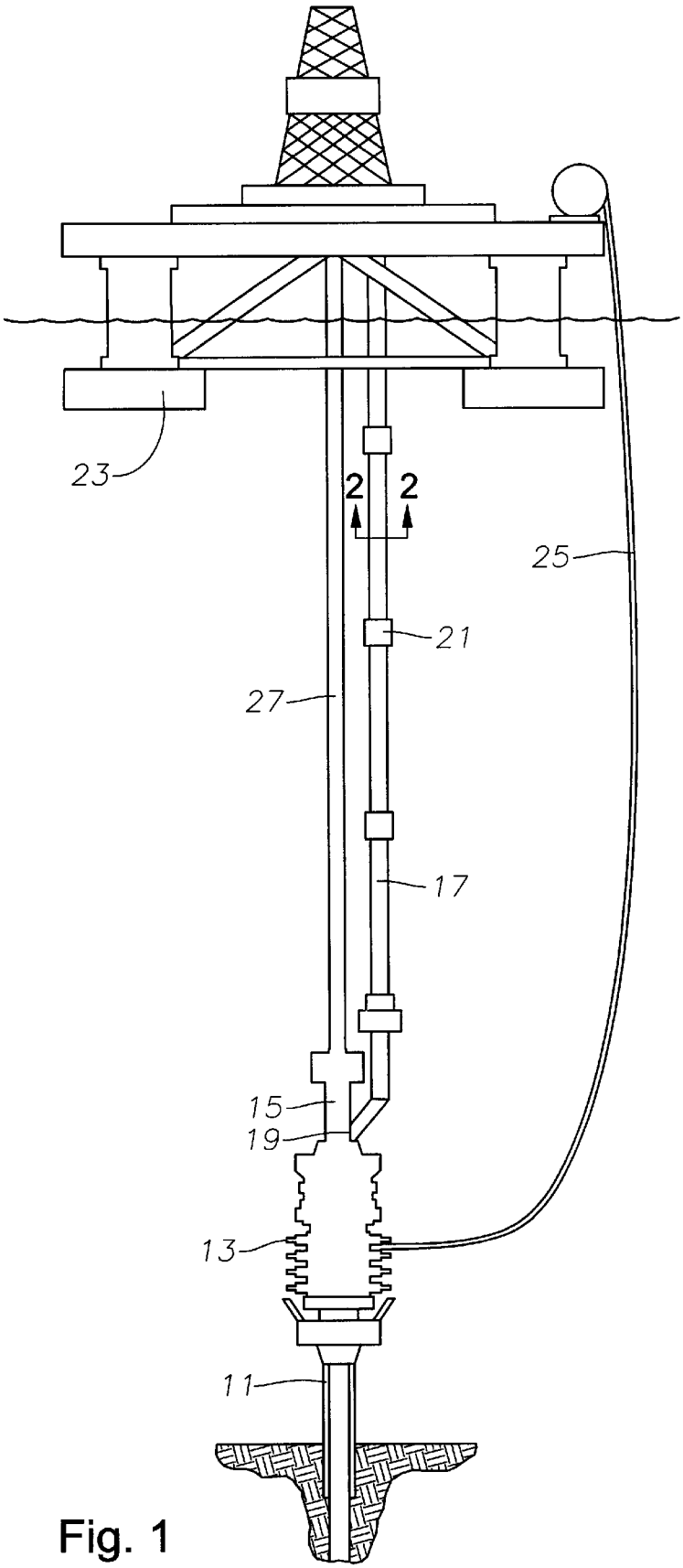
FIG. 1 is a schematic view of a riser constructed in accordance with this invention, shown offset from the drill pipe for conveying drilling mud back to the drilling rig.

Referring to FIG. 1, a subsea wellhead assembly 11 will be located at the sea floor. A conventional blowout preventer 13 is mounted to the subsea wellhead for controlling the well during drilling. A drilling head 15 is mounted on top of the stationary blowout preventer 13. Drilling head 15 has a rotatable inner portion that will seal against and rotate with the drill pipe during drilling. By forming a seal with drill pipe 27, drilling head 15 prevents drilling fluid returns flowing up the annulus around drill pipe 27 from discharging onto the seabed. One type of a drilling head 15 is shown in U.S. Pat. No. 5,662,171.

A small diameter riser 17 extends upward from drilling head 15. Riser 17 may be smaller in diameter than the drill bit used to drill the smallest portion of the well. For example, it may have a 6⅜" bore. Riser 17 has a lower end 19 that connects into drilling head 15 below the seal with the drill pipe 27 for receiving the mud-returns flowing up around the annulus of drill pipe 27. Riser 17 is offset from and parallel to drill pipe 27. Riser 17 is preferably made up of sections of conduit joined together by threaded union type connectors 21 which allow rapid make-up and break-out. A subsea valve manifold (not shown) controls fluids returning up riser 17. For example, in the event of a well kick, the valve manifold will choke or kill the returning fluid.

Figure 2:
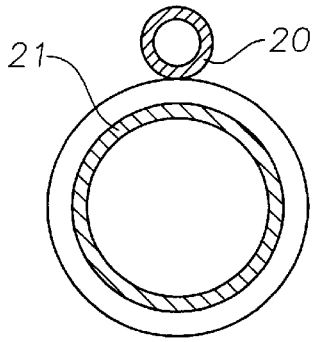
FIG. 2 is a sectional view of the riser of FIG. 1 taken along the line 2—2 of FIG. 1.

As shown in FIG. 2, riser 17 also includes at least one auxiliary line 20 which extends alongside it and is much smaller in diameter. Auxiliary line 20 serves as a choke-and-kill line for various purposes as will be explained below. Riser 17 extends to a floating drilling rig 23. Motion compensators (not shown) will accommodate for wave movement of drilling rig 23. Similarly, drill pipe 27 extends to a draw works and rotational drive mechanism on floating drilling rig 23. An umbilical line 25 will extend from drilling rig 23 to stationary blowout preventer 13 for supplying hydraulic power to actuate the blowout preventer 13. Umbilical line 25 also will supply hydraulic fluid pressure and control to drilling head 15 and/or a valve manifold. Rather than an umbilical, in some cases, the hydraulic fluid supply and controls could be made through the existing blowout preventer control system.

Although not shown, there will likely be a funnel or guiding system for guiding drill pipe 27 into drilling head 15. Also, a subsea pump (not shown) may be located at the lower end of riser 17 for pumping drilling fluid returns up riser 17. If so, the drilling fluid in the annulus surrounding drill pipe 27 will be isolated from the hydrostatic weight of the fluid within riser 17. Also, if desired, an assembly may be located at the seafloor for removing cuttings from the drilling fluid rather than at the rig 23.

During drilling, drill pipe 27 is rotated and drilling mud is pumped down from drilling rig 23 through drill pipe 27. The drilling fluid flows back the annulus in the well surrounding drill pipe 27 along with cuttings. The returns flow into riser 17 and back to the surface.

Figure 3:
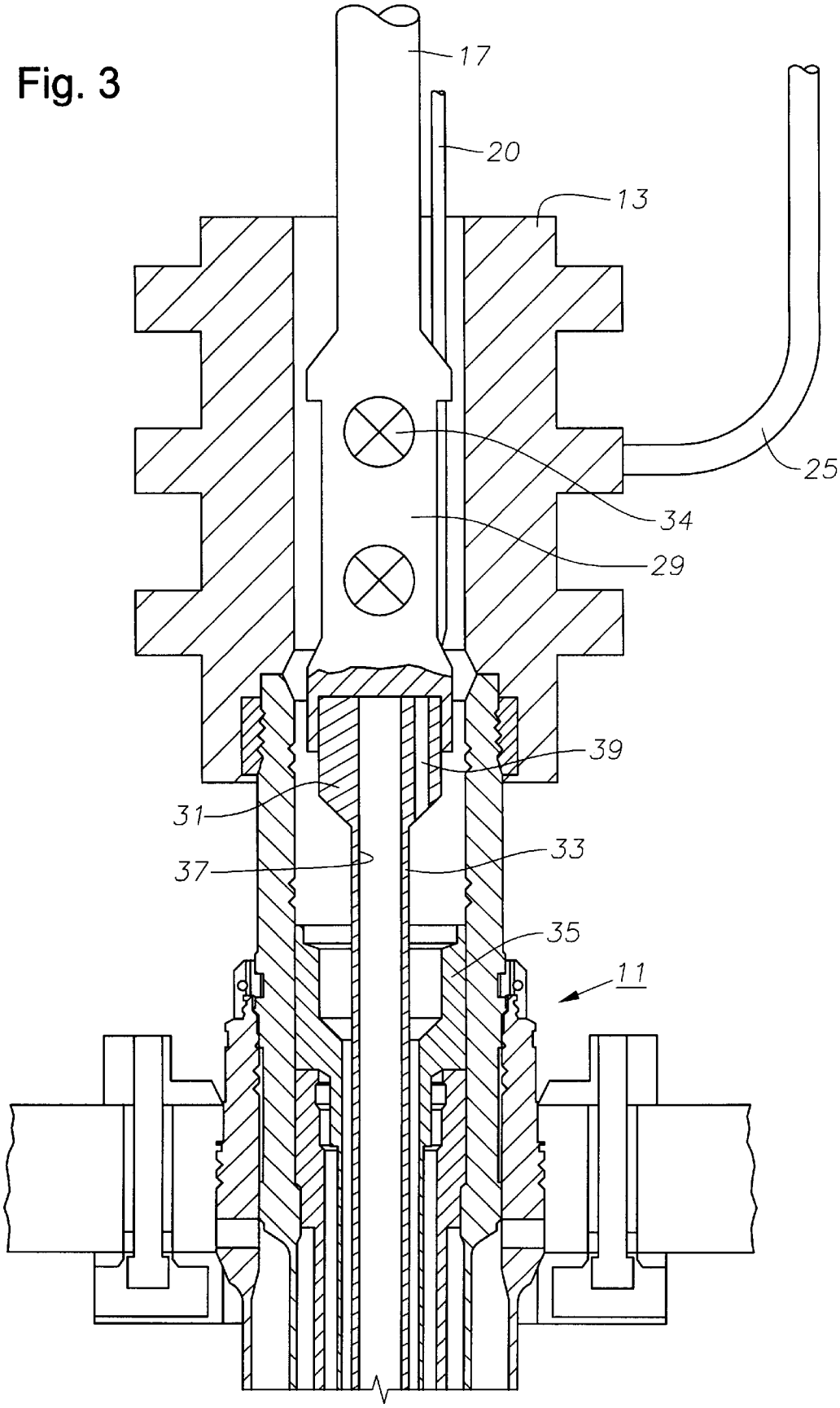
FIG. 3 is a schematic sectional view of the wellhead of the subsea well being drilled in FIG. 1, shown with the riser being used to run tubing after the drilling has been completed.

Casing will also be run through the drilling head 15 and stationary blowout preventer 13. The casing will be run alongside riser 17, which remains connected to subsea wellhead assembly 11. Returns from cementing will flow up riser 17. After the well has been drilled to total depth and cased, one method would be to then run tubing 33 as illustrated in FIG. 3. This is performed by first releasing drilling head 15 from blowout preventer 13 and retrieving it along with riser 17. The stationary blowout preventer 13 will remain in place connected to the wellhead housing of wellhead 11. With some designs, an insert can be removed from drilling head 15 to prevent full bore access to the well without removal of the complete drilling head.

The operator then secures riser 17 to a subsea test tree and running tool 29. Running tool 29 is connected to a conventional tubing hanger 31. Tubing hanger 31 is secured to tubing 33. Riser 17, along with its auxiliary line 20, will be made up and lowered again, lowering tubing 33 into the well. Tubing hanger 31 will land in subsea wellhead 11 above the uppermost casing hanger 35. Tubing hanger 31 has a production bore 37 which extends axially through it and communicates with tubing 33. Tubing hanger 31 also has an offset annulus passage 39 which extends through it to communicate the annulus surrounding tubing 33 to above tubing hanger 31. Tubing hanger 31 has an annular seal (not shown) which seals it within subsea wellhead 11.

Subsea test tree and running tool 29 has a production passage which aligns with tubing hanger passage 33 and has valves 34 for selectively opening and closing the production passage. Subsea test tree and running tool 29 also has an annulus passage (not shown) which connects tubing hanger annulus passage 39 to auxiliary line 20. This enables the operator to circulate fluid down production string 33 and back up the tubing annulus and through auxiliary line 20 to the vessel. Normally, the well will be perforated and tested at this point. A wireline or coiled tubing conveyed perforating gun may be lowered through riser 17, test tool 29, tubing hanger passage 37 and tubing 33 for perforating the casing. Wireline instruments may be lowered though riser 17 and tubing 33 for logging and performing other functions such as shifting a sliding sleeve to close off the lower end of the tubing 33 to the tubing annulus. After the completion of testing, the operator will lower a retrievable plug through riser 17 on wireline. The operator sets the plug in tubing hanger passage 37. Annulus passage 39 may also be plugged by using a device which will orient a second retrievable wireline plug into the annulus passage 39. The operator then disconnects subsea running tool and test tree 29 and retrieves it to the surface by retrieving riser 17. The operator also removes stationary blowout preventer 13.

Figure 4:
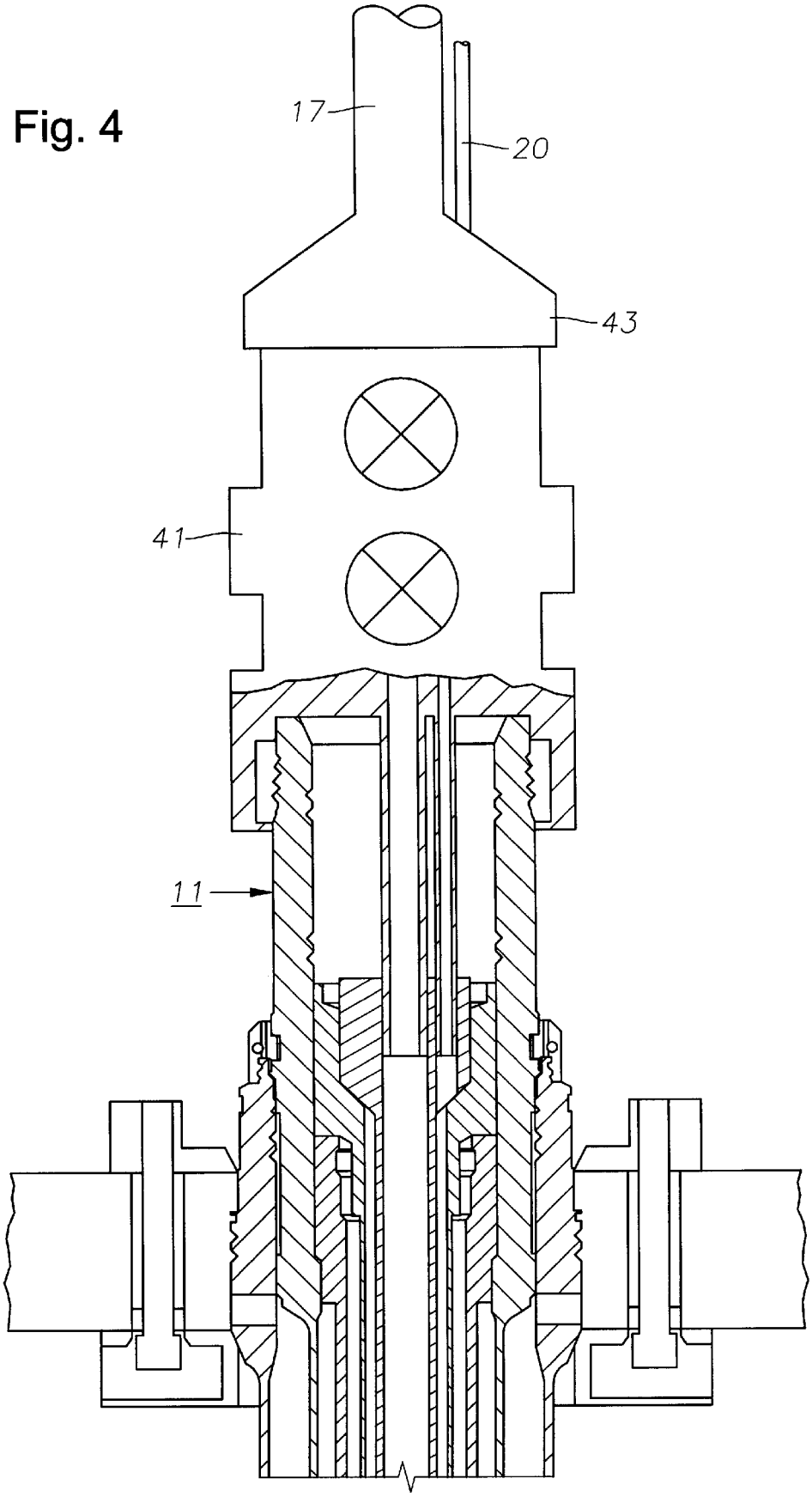
FIG. 4 is a sectional view of the wellhead of FIG. 4, showing the riser being used to run a Christmas tree or workover a well.

Then, as shown in FIG. 4, the operator will connect a subsea Christmas tree 41 to a running tool 43. The running tool 43 will be connected to riser 17, which is again lowered into the sea. The running tool 43 lands and connects Christmas tree 41 to subsea wellhead 11. Christmas tree 41 will have tubular stingers 45, 47 which insert into the tubing hanger bores 37, 39 for annulus and production control. The operator will lower a wireline retrieval tool through riser 17 for withdrawing the production plug from passage 37 and annulus plug from tubing hanger annulus passage 39. The operator has access to the production passage in tubing 33 and to the tubing annulus through the bore of riser 17 and auxiliary line 20. Running tool 43 will then be removed and riser 17 retrieved. A cap will be secured to the upper end of Christmas tree 41.

Riser 17 can also be used to install a horizontal tree (not shown) rather than a conventional tree as has been previously described. An example of a horizontal tree is shown in U.S. Pat. No. 5,465,794. In a horizontal tree, the tubing hanger has a lateral production passage and lands in the tree rather than in the wellhead housing. In the method of this invention, the tree will be run and secured to subsea wellhead 11 before installing tubing 33 and tubing hanger 31. The tree will be run using riser 17. Subsequently, riser 17 will be employed along with running and test tool 29 to run tubing hanger 31 and tubing 33. Tubing hanger 31 lands in a receptacle within the tree, which serves as a wellhead in this instance. Perforating and various test operations are carried out using riser 17 and its auxiliary line 20 in the same manner as previously described. In a horizontal tree, a bypass passage extends around the tubing hanger and communicates the tubing annulus with the auxiliary line.

The invention has several advantages. The subsea well assembly of the invention removes the water depth fluid column hydrostatic effects on the formation through riserless drilling. This results in increasing sensitivity and well depth potential. Additionally the invention reduces "dead" mud volume in the riser. The subsea drill sting is useable in open water where conventional riser drilling is not suitable.

Although the invention has been shown in only one of its forms, it should be apparent to one skilled in the art that it is not so limited, but is susceptible to change without departing from the scope of the invention.

We claim:

1. A method of drilling and completing a well subsea, comprising:

(a) supporting a rotatable drilling head on a subsea wellhead assembly;

(b) connecting a riser from a drilling vessel to the drilling head;

(c) connecting a drill bit to a string of drill pipe and lowering the drill pipe from the drilling vessel alongside the riser, through the drilling head and into the well, defining a drill pipe annulus in the well which is sealed at the subsea wellhead assembly by the drilling head;

(d) rotating the drill bit and drilling head, pumping drilling fluid down the drill pipe and into the drill pipe annulus, and returning the drilling fluid from the drill pipe annulus to the riser, and through the riser to the drilling vessel; then (e) after the well has been drilled, employing the riser to run tubing and complete the well.

2. The method according to claim 1, wherein step (e) comprises:

retrieving the riser;

making up a string of tubing to a tubing hanger, securing a tubing hanger running tool to a lower end of the riser and the tubing hanger to the tubing hanger running tool; then with the riser, lowering the string of tubing into the subsea wellhead assembly.

3. The method according to claim 2, further comprising running a perforating gun through the riser and into the string of tubing and perforating the well.

4. The method according to claim 1, wherein step (b) comprises providing the riser with a main conduit and an offset auxiliary line; and wherein step (e) comprises employing the auxiliary line for tubing annulus access.

5. The method according to claim 4, wherein step (e) comprises:

communicating a tubing annulus with the auxiliary line; and pumping completion fluid down the main conduit and the tubing, and flowing the completion fluid back up the tubing annulus and auxiliary line.

6. The method according to claim 1, wherein step (b) comprises providing the riser with sections which are screwed together.

7. The method according to claim 1, wherein step (c) comprises employing a drill bit larger in diameter than an inner diameter of the riser.

8. The method according to claim 1, wherein step (d) further comprises running casing alongside the riser and into the well.

9. A method of drilling and completing a well subsea, comprising:

(a) supporting a rotatable drilling head on a subsea wellhead assembly;

(b) connecting a riser from a drilling vessel to the drilling head, the riser having a main conduit and an auxiliary line;

(c) securing a drill bit to a string of drill pipe, lowering the drill pipe from the drilling vessel alongside the riser, through the drilling head and into the well, defining a drill pipe annulus in the well which is sealed at the subsea wellhead assembly by the drilling head;

(d) rotating the drill bit and drilling head, pumping drilling fluid down the drill pipe and into the drill pipe annulus, returning the drilling fluid from drill pipe annulus to the riser, and through the riser to the drilling vessel;

(e) runnning at least two strings of casing alongside the riser into the well, cementing the casing and causing cement returns to flow up the riser; then (f) after the well has been drilled and cased, retrieving the riser, securing a tubing hanger running tool to the riser, and a tubing hanger and string of tubing to the riser; then (g) with the riser, lowering the tubing into the well, creating a tubing annulus; then (h) communicating the tubing with the main conduit of the riser and the tubing annulus with the auxiliary line.

10. The method according to claim 9, wherein step (h) further comprises:

lowering a perforating gun through the main conduit and through the tubing and perforating the well; then retrieving the riser.

11. The method according to claim 9, wherein step (h) further comprises: pumping a completion fluid down the main conduit of the riser and the tubing, and flowing the completion fluid from the tubing annulus into the auxiliary line.

12. The method according to claim 9, wherein step (b) comprises providing the riser with sections which are screwed together.

13. The method according to claim 9, wherein step (c) comprises employing a drill bit larger in diameter than an inner diameter of the main conduit of the riser.

14. The method according to claim 9, wherein the subsea wellhead assembly comprises a wellhead housing and a blowout preventer, and step (a) comprises mounting the rotating drilling head to the blowout preventer.

15. The method according to claim 9, wherein step (f) further comprises:

retrieving at least a portion of the rotating drilling head prior to running the tubing.

16. A method of drilling and completing a well subsea, comprising:

(a) connecting sections of a riser together and extending the riser from a drilling vessel to a subsea wellhead assembly, the riser having a main conduit and an auxiliary line, both of which are offset from a main bore of the subsea wellhead assembly;

(b) securing a drill bit to a string of drill pipe, lowering the drill pipe from the drilling vessel alongside the riser, through the main bore of the subsea wellhead assembly and into the well, defining a drill pipe annulus in the well;

(c) rotating the drill bit, pumping drilling fluid down the drill pipe and into the drill pipe annulus, returning the drilling fluid from the drill pipe annulus to the riser, and through the riser to the drilling vessel;

(d) runnning at least two strings of casing alongside the riser and into the well, cementing the casing and causing cement returns to flow up the riser; then (e) after the well has been drilled and cased, retrieving the riser, securing a tubing hanger running tool to the main conduit of the riser, and a tubing hanger and string of tubing to the tubing hanger running tool; then (f) with the riser, lowering the tubing into the well, creating a tubing annulus;

(g) pumping completion fluid down the main conduit of the riser and down the tubing into the tubing annulus, and returning the completion fluid from the tubing annulus up the auxiliary line; and (h) lowering a perforating gun through the main conduit of the riser into the tubing and perforating the well; then (i) closing the tubing and the tubing annulus at the subsea wellhead assembly and retrieving the riser.

17. The method according to claim 16, wherein step (b) comprises employing a drill bit larger in diameter than an inner diameter of the main conduit of the riser.

18. The method according to claim 16, wherein the the subsea wellhead assembly comprises a wellhead housing and a blowout preventer, and step (a) comprises mounting a rotating drilling head to the blowout preventer.

* * * * *

UNITED STATES PATENT AND TRADEMARK OFFICE

CERTIFICATE OF CORRECTION

PATENT NO. : 6,142,236
DATED : November 7, 2000
INVENTOR(S) : Norman Brammer and Philippe Nobileau It is certified that error appears in the above-identified patent and that said Letters Patent is hereby corrected as shown below:

Title page,
Please add the assignee as follows: ABB Vetco Gray, Inc., Houston, Texas Signed and Sealed this Twenty-fifth Day of September, 2001

*Attest:*

Nicholas P. Godici

NICHOLAS P. GODICI
*Acting Director of the United States Patent and Trademark Office*

*Attesting Officer*